US006558485B2

(12) United States Patent
Moreman, III

(10) Patent No.: US 6,558,485 B2
(45) Date of Patent: May 6, 2003

(54) LASER SHOCK PEENING WITH AN EXPLOSIVE COATING

(75) Inventor: Otis S. Moreman, III, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/928,605

(22) Filed: Aug. 13, 2001

(65) Prior Publication Data

US 2003/0029522 A1 Feb. 13, 2003

(51) Int. Cl.[7] ..... B23K 26/40

(52) U.S. Cl. ..... 148/525; 148/565; 219/121.61; 219/121.85

(58) Field of Search ..... 148/525, 565; 219/121.61, 121.8, 121.82, 121.85

(56) References Cited

U.S. PATENT DOCUMENTS

| | | | | |
|---|---|---|---|---|
| 4,014,720 A | | 3/1977 | Wells | |
| 4,093,478 A | | 6/1978 | Hurst | |
| 4,555,279 A | | 11/1985 | Funk | |
| 5,445,690 A | | 8/1995 | Wulfman | |
| 5,468,313 A | | 11/1995 | Wallace, II et al. | |
| 5,674,328 A | | 10/1997 | Mannava et al. | |
| 5,674,329 A | | 10/1997 | Mannava et al. | |
| 5,932,120 A | | 8/1999 | Mannava et al. | |
| 6,005,219 A | * | 12/1999 | Rockstroh et al. | 219/121.85 |
| 6,127,649 A | | 10/2000 | Toller et al. | |
| 6,159,619 A | | 12/2000 | Rockstroh et al. | |
| 6,170,398 B1 | | 1/2001 | Rabotinsky et al. | |
| 6,200,689 B1 | * | 3/2001 | Ferrigno et al. | 148/565 |
| 6,215,097 B1 | | 4/2001 | Mannava | |
| 6,228,192 B1 | | 5/2001 | Neidert et al. | |
| 2002/0096503 A1 | * | 7/2002 | Hackel et al. | 219/121.85 |

* cited by examiner

*Primary Examiner*—George Wyszomierski
(74) *Attorney, Agent, or Firm*—V. G. Ramaswamy; Steven J. Rosen

(57) ABSTRACT

A method of laser shock peening a metallic part by firing a laser on a coated laser shock peening surface of the part which has been covered with an explosive coating containing at least one explosive ingredient. Two or more explosive ingredients having different shock sensitivities may be used and the laser beam is fired with sufficient power to explode at least some amount of each of the explosive ingredients. One embodiment of the invention includes forming an ablative coated surface by coating a laser shock peening surface on the workpiece with an ablative material containing at least one explosive ingredient, continuously firing a laser beam which repeatably pulses between relatively constant periods, on the coated surface of the workpiece while providing continuous movement between the laser beam and the metallic workpiece, and firing the laser beam with sufficient power to vaporize the ablative material of the coating and to explode at least some of the explosive ingredient with the pulses and forming laser beam spots on the coating and forming a region in the workpiece having deep compressive residual stresses imparted by the laser beam pulsing such that the region extends into the workpiece from the laser shock peening surface. Suitable explosive ingredients include nitroglycerin and ammonium nitrate. One or more oxidizers may be added to an ablative material to form the explosive coating in the form of a tape or film coating.

48 Claims, 7 Drawing Sheets

LASER SHOCK PEENING WITH AN EXPLOSIVE COATING

GOVERNMENT INTERESTS

This invention was made with Government support under Contract No. F33657-95-C-0055 awarded by the Department of the Air Force. The Government has certain rights in this invention.

BACKGROUND OF THE INVENTION

1. Field of the Invention

This invention relates to laser shock peening of metallic objects such as gas turbine engine parts and, more particularly, to coating laser shock peening surfaces of a workpiece with an ablative material containing one or more explosive ingredients.

2. Description of Related Art

Laser shock peening or laser shock processing, as it is also referred to, is a process for producing a region of deep compressive residual stresses imparted by laser shock peening a surface area of a workpiece. Laser shock peening typically uses multiple radiation pulses from high power pulsed lasers to produce shock waves on the surface of a workpiece similar to methods disclosed in U.S. Pat. No. 3,850,698, entitled "Altering Material Properties"; U.S. Pat. No. 4,401,477, entitled "Laser Shock Processing"; and U.S. Pat. No. 5,131,957, entitled "Material Properties". Laser peening, as understood in the art and as used herein, means utilizing a laser beam from a laser beam source to produce a strong localized compressive force on a portion of a surface by producing an explosive force by instantaneous ablation or vaporization of a painted or coated or uncoated surface. U.S. Pat. No. 5,674,329, entitled "Adhesive Tape Covered Laser Shock Peening" and U.S. Pat. No. 5,674,328, entitled "Dry Tape Covered Laser Shock Peening" disclose the use of tape having an ablative layer as the ablative coating. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". These methods typically employ a curtain of water flowed over the workpiece or a transparent coating such as a clear plastic layer and ablative layer of a tape placed over workpiece. The curtain of water and clear tape layer provides a confining medium to confine and redirect the process generated shock waves into the bulk of the material of a component being LSP'D to create the beneficial compressive residual stresses. This water or other fluid confining medium also serves as a carrier to remove process generated debris and any unused laser beam energy. U.S. Pat. No. 5,932,120 entitled "Laser Shock Peening Using Low Energy Laser" discloses the use of low power lasers and laser beams which are less expensive to procure and use than the higher power lasers disclosed previously.

Laser shock peening is a process that, as any production technique, involves machinery and is time consuming and expensive. Therefore, any techniques that can reduce the amount or complexity of production machinery and/or production time are highly desirable.

BRIEF DESCRIPTION OF THE INVENTION

A method of laser shock peening a metallic part by firing a laser on a coated laser shock peening surface of the part which has been coated with a material having at least one explosive ingredient. Two or more explosive ingredients may be used wherein each of the explosive ingredients has a different shock sensitivity and the laser beam is fired with sufficient power to vaporize the coating and explode at least some amount of each of the explosive ingredients.

One embodiment of the invention includes forming an explosive coated surface by coating a laser shock peening surface on the workpiece with a material containing at least one explosive ingredient, continuously firing a laser beam which repeatably pulses between relatively constant periods, on the coated surface of the workpiece while providing continuous movement between the laser beam and the metallic workpiece, and firing the laser beam with sufficient power to explode at least some of the explosive ingredient with the pulses and forming laser beam spots on the coating and forming a region in the workpiece having deep compressive residual stresses imparted by the laser beam pulsing such that the region extends into the workpiece from the laser shock peening surface. Another embodiment of the invention includes forming an ablative coated surface by coating a laser shock peening surface on the workpiece with an ablative material containing at least one explosive ingredient, continuously firing a laser beam which repeatably pulses between relatively constant periods, on the coated surface of the workpiece while providing continuous movement between the laser beam and the metallic workpiece, and firing the laser beam with sufficient power to vaporize the ablative medium of the coating and to explode at least some of the explosive ingredient with the pulses and forming laser beam spots on the coating and forming a region in the workpiece having deep compressive residual stresses imparted by the laser beam pulsing such that the region extends into the workpiece from the laser shock peening surface. Various embodiments of the invention includes flowing a fluid curtain, while firing the laser beam over the coated surface upon which the laser beam is firing to form a pattern of overlapping laser beam spots, while moving the laser relative to the workpiece. In alternate embodiments, the coating material contains two or more explosive ingredients wherein each of the explosive ingredients has a different shock sensitivity and the laser beam is fired with sufficient power to explode at least some amount of each of the explosive ingredients. Suitable explosive ingredients nitroglycerin, pentaerythritol tetranitrate (PETN), RDX, and ammonium nitrate.

The laser shock peening surface may be coated with a film using an adhesive or a self-adhering tape containing the explosive ingredients. The film or tape may include an ablative material. The ablative coated surface may be formed by coating the laser shock peening surface with a liquid coating with or an ablative material and containing the explosive ingredient(s) and then drying the coating on the laser shock peening surface. The laser shock peening surface may be coated with an ablative material and an oxidizer which acts as the explosive ingredient. The present invention enhances the explosive force of laser shock peening and, thus, can be used to lower the power of the laser, increase the size of the laser beam spot, and in turn, lower the cost, time, man power and complexity of laser shock peening.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
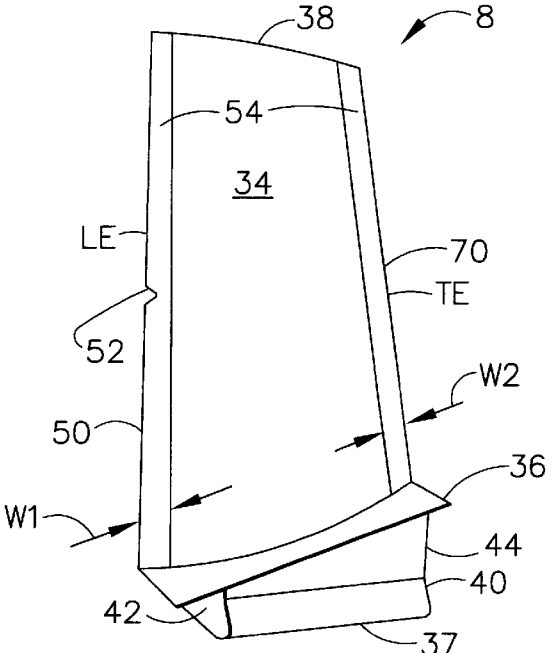
FIG. 1 is a perspective view of a fan blade to be processed in accordance with an exemplary embodiment of the method of the present invention.
Figure 2:
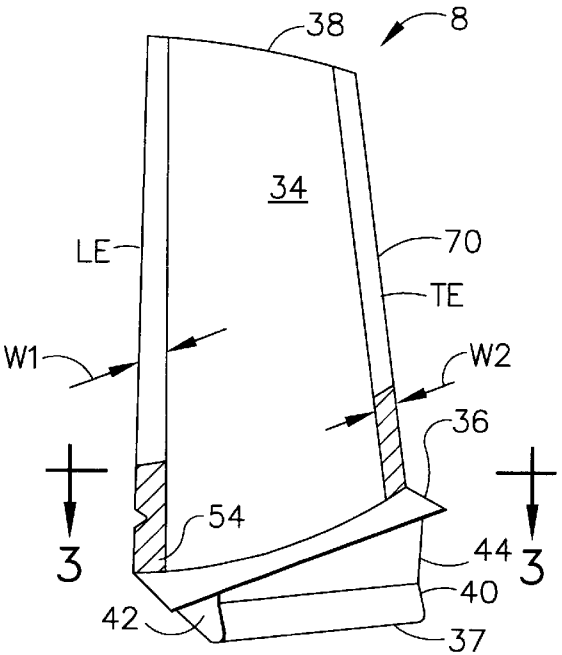
FIG. 2 is a perspective illustrative view of the exemplary aircraft gas turbine engine fan blade in FIG. 1 having been laser shock peened in accordance with a method of the present invention.
Figure 3:
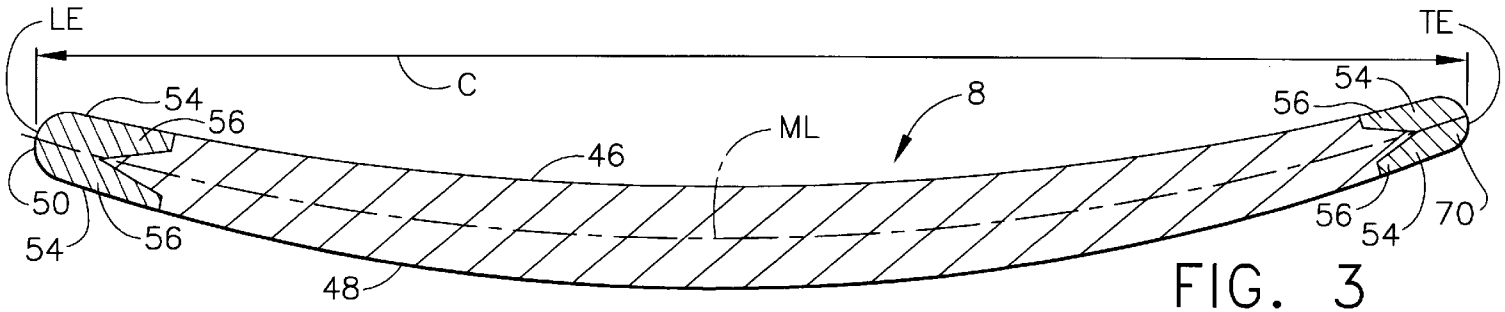
FIG. 3 is a cross-sectional view through the fan blade taken along line 3—3 as illustrated in FIG. 2.

Illustrated in FIGS. 1, 2 and 3, is a fan blade 8 having an airfoil 34 made of a Titanium alloy extending radially outward from a blade platform 36 to a blade tip 38. This is representative of a type of hard metallic part or a workpiece and material upon which the method of the present invention is used. The fan blade 8 includes a root section 40 extending radially inward from the platform 36 to a radially inward end 37 of the root section 40. At the radially inward end 37 of the root section 40 is a blade root 42 which is connected to the platform 36 by a blade shank 44. The airfoil 34 extends in the chordwise direction between a leading edge LE and a trailing edge TE of the airfoil. A chord C of the airfoil 34 is the line between the leading LE and trailing edge TE at each cross section of the blade as illustrated in FIG. 3. The airfoil 34 has a pressure side 46 and a suction side 48. A mean-line ML is generally disposed midway between the two sides and extends in the chordwise direction.

The airfoil 34 has a leading edge section 50 that extends along the leading edge LE of the airfoil 34 from the blade platform 36 to the blade tip 38. The leading edge section 50 includes a predetermined first width W1 such that the leading edge section 50 encompasses nicks 52 and tears that may occur along the leading edge of the airfoil 34. The airfoil 34 is subject to a significant tensile stress field due to centrifugal forces generated by the fan blade 8 rotating during engine operation. The airfoil 34 is also subject to vibrations generated during engine operation and the nicks 52 and tears operate as high cycle fatigue stress risers producing additional stress concentrations around them. Laser shock peening has been developed to counter fatigue failure of workpieces such as of portions of the blade along possible crack lines that can develop and emanate from the nicks and tears at least one and, preferably, both of the pressure side 46 and the suction side 48. FIGS. 2 and 3 illustrate laser shock peened surfaces 54 and pre-stressed regions 56 having deep compressive residual stresses imparted by a laser shock peening (LSP) method in accordance with the present invention.

Figure 4:
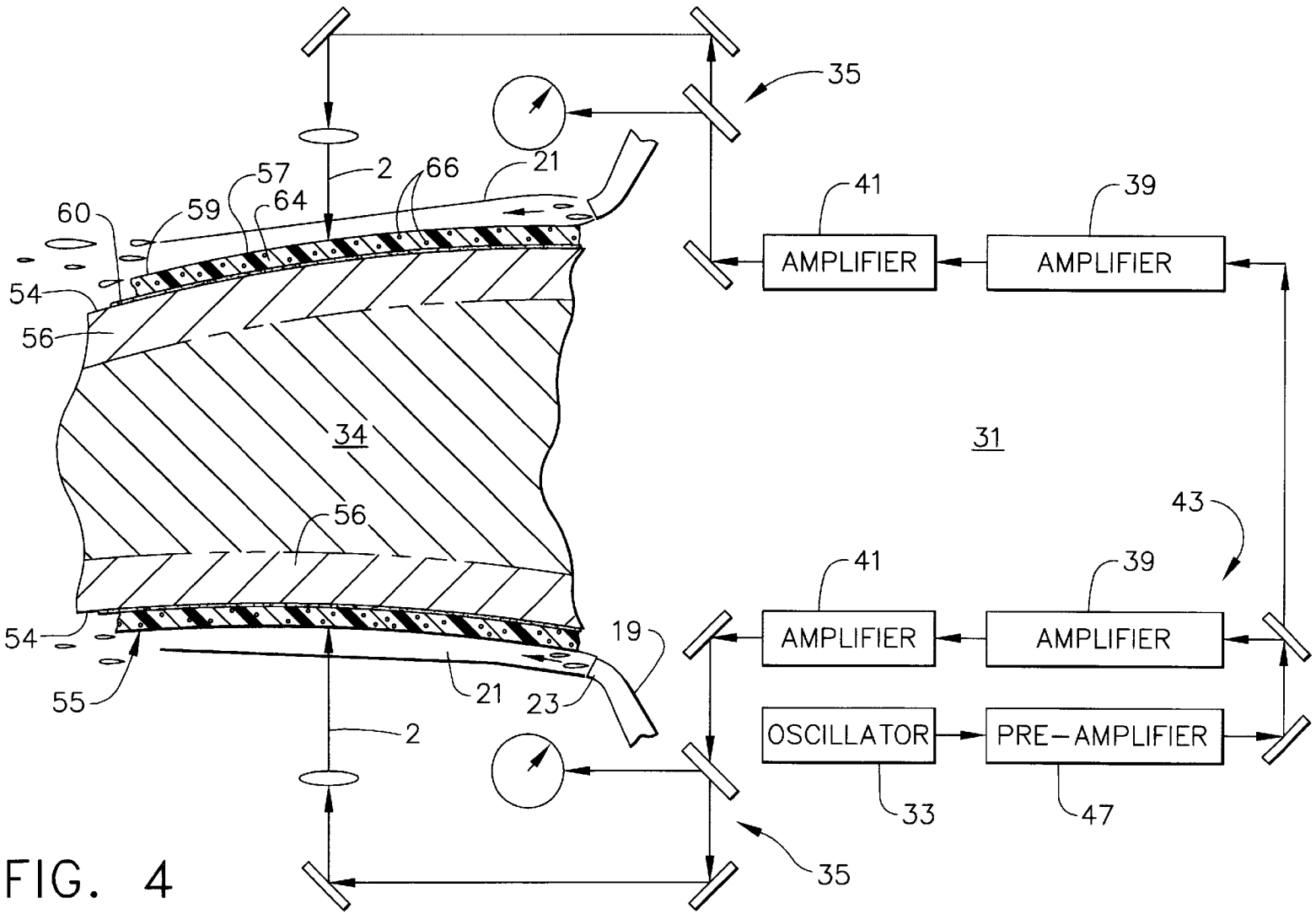
FIG. 4 is a partial cross-sectional and a partial schematic view of the fan blade in FIG. 1 being laser shock peened with an exemplary embodiment of the method of the present invention.
Figure 5:
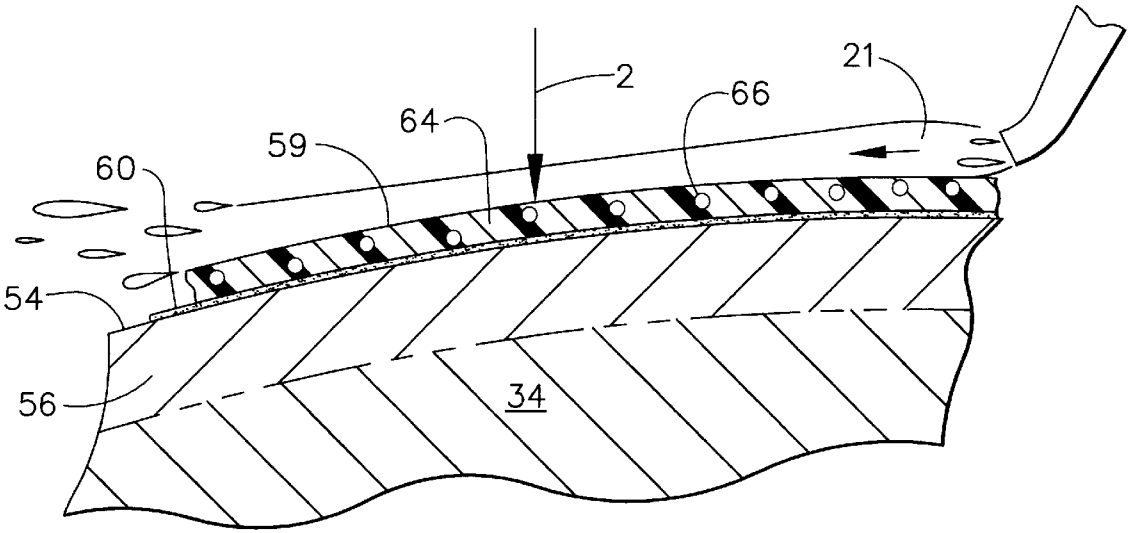
FIG. 5 is an enlarged view of the blade illustrated in FIG. 4 having a taped coating or film on the blade edges.

Illustrated in FIGS. 4 and 5 is a schematic representation of the airfoil 34 which is representative of a workpiece in the process of being treated with an exemplary embodiment of a laser shock peening method of the present invention. The laser shock peening surface 54 is covered by an explosive coating 57 which contains at least one explosive ingredient 66. The coating 57 may be an ablative coating with the explosive ingredient 66 mixed into or suspended in an ablative material 64. Alternatively, the ablative material may be mixed with an oxidizer to provide the explosive coating 57. Examples of suitable explosive ingredients include nitroglycerin, pentaerythritol tetranitrate, RDX, and ammonium nitrate. Nitroglycerin and ammonium nitrate are thought to be particularly suitable.

Figure 9:
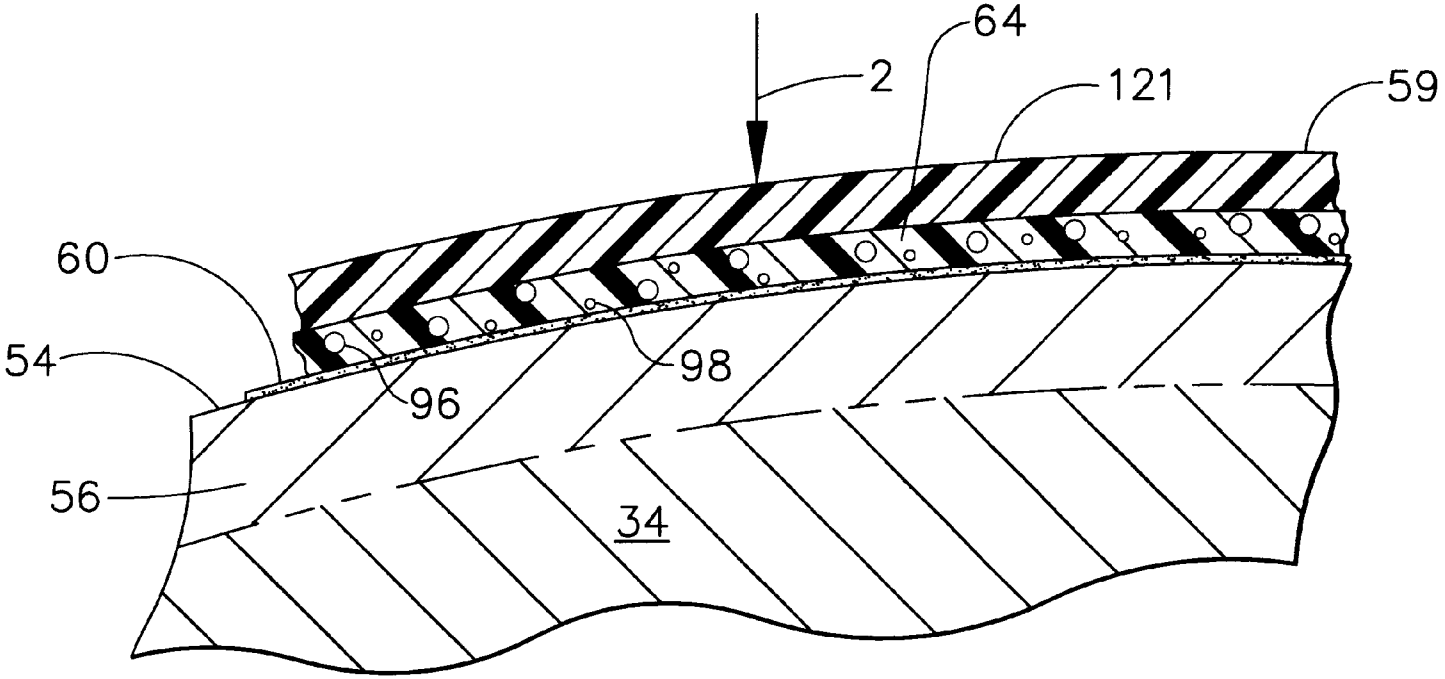
FIG. 9 is a view of the blade having two explosive ingredients in an ablative material of a tape having an outer layer of clear plastic serving as a confinement medium for a method of the present invention.

The coating 57 in FIG. 4 is a tape 59 having a layer of the ablative material 64 and an adhesive layer 60. The ablative material 64 serves as a plasticizer to suspend the explosive ingredient 66 in the coating or tape. Alternatively, a non-ablative or an ablative material 64 may be used to form a plasticized film instead of the tape 59 to provide the coating 57 and the film is bonded to the laser shock peening surface 54 with the adhesive layer 60. A clear fluid curtain such a flow of water over the laser shock peening surface 54 provides a clear confining layer 21 in the embodiment illustrated in FIG. 4. A clear plastic confining layer 21 may also be used in place of a fluid curtain such as water. The film or tape 59 may have a self-adhering adhesive layer or a suitable adhesive material may be applied directly to the laser shock peening surface 54 before applying the film or tape. Suggested materials for the ablative and confining layers include plastic, such as vinyl plastic film, wherein the ablative medium may be pigmented black and the confining layer pigmented clear. The film or tape 59 should be rubbed or otherwise pressed against the shock peening surface 54 to remove bubbles that may remain between the tape and the laser shock peening surface. The tape 59 may incorporate a clear layer of plastic 121 instead of or in combination with using a curtain of flowing water that is the clear confining layer 21 as illustrated in FIG. 9.

Figure 8:
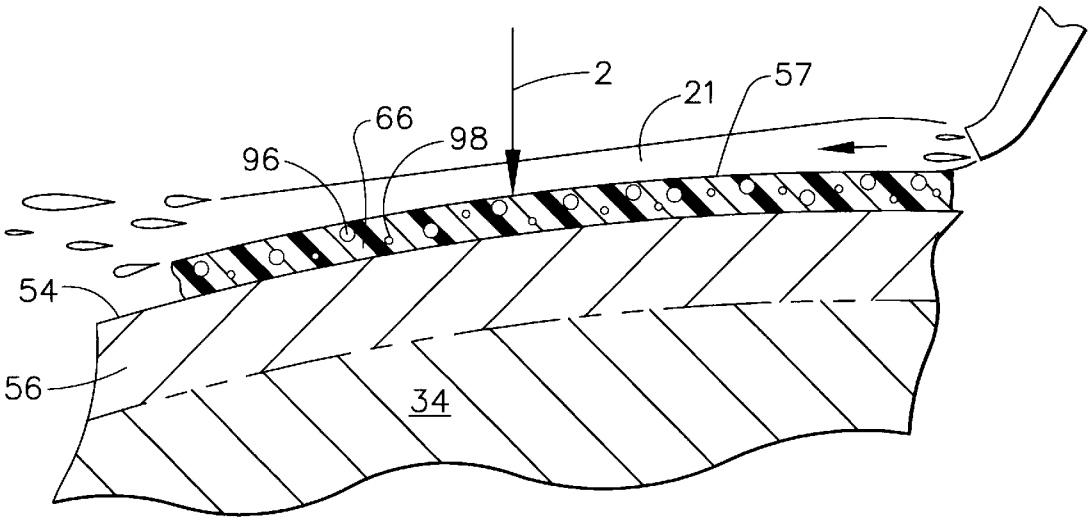
FIG. 8 is a view of the blade having a painted coating with the explosive ingredient in the ablative material of the coating on the laser shock peened surface of the blade.

The laser shock peening surfaces 54 can also be coated or covered with a liquid or paint containing the ablative material 64 and the explosive ingredient 66. The liquid or paint is dried to form the coating 57 of the coated surface 55 before firing the laser as illustrated in FIG. 8. Alternatively, the ablative material may be mixed with an oxidizer to provide the liquid or paint which is then dried to provide the explosive coating 57.

The tape and the dried liquid coating or paint is considered a coating of the laser shock peening surface 54 for the purposes of this patent. The fan blade 8 also has a trailing edge section 70 that extends along the trailing edge TE of the airfoil 34 from the blade platform 36 to the blade tip 38. The trailing edge section 70 includes a predetermined second width W2 in which it may also be desirable to form laser shock peening surfaces 54 and pre-stressed regions 56 having deep compressive residual stresses imparted by laser shock peening (LSP) extending into the airfoil 34 from the laser shock peened surfaces as illustrated in FIG. 2.

Figure 10:
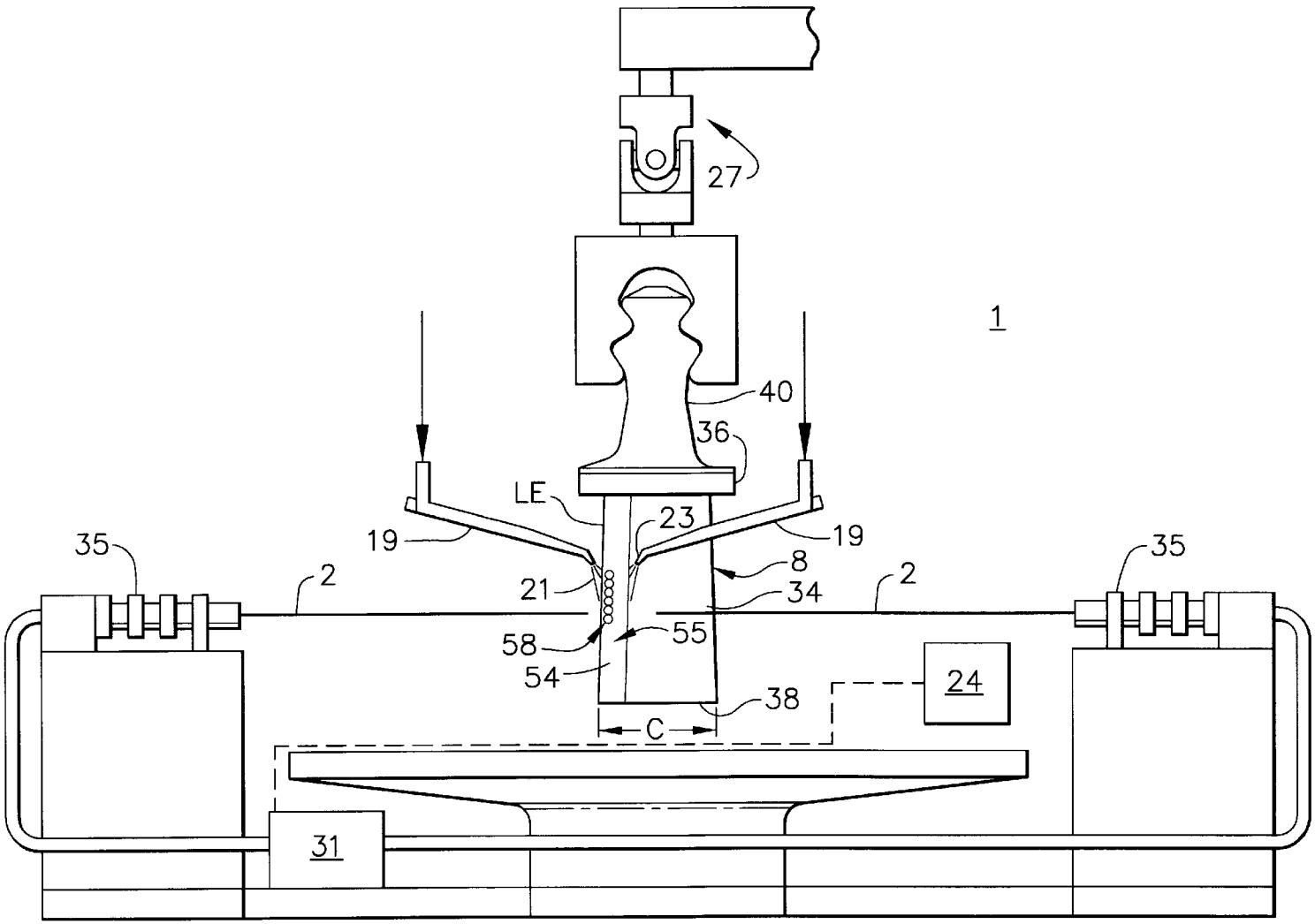
FIG. 10 is a schematical perspective view of the blade of FIG. 1 coated and mounted in a laser shock peening system illustrating the method of the present invention.

The laser shock peening apparatus 1, illustrated herein in FIGS. 10 and 4, includes a laser beam apparatus including a generator 31 having an oscillator and a pre-amplifier and a beam splitter which feeds the pre-amplified laser beam into two beam optical transmission circuits each having a first and second amplifier 39 and 41, respectively, and optics 35 which include optical elements that transmit and focus the laser beam 2 on the laser shock peening coated surface 55. A controller 24 may be used to modulate and fire the laser beam apparatus to fire the laser beam 2 on the laser shock peening coated surface 55 in a controlled manner.

The laser beam shock induced deep compressive residual stresses are produced by repetitively firing a high energy laser beam 2 that is defocused plus or minus a few mils with respect to the laser shock peening coated surface 55. The ablative medium is vaporized or ablated generating plasma which results in shock waves on the surface of the material. The explosive ingredient explodes when the laser is fired enhancing the shock waves and the depth and strength of the compressive residual stresses. The laser beam 2 is fired through a curtain of flowing water that is flowed over the coated laser shock peened surface 54 or other clear confining layer 21. The coating is ablated and the explosive ingredient is essentially simultaneously exploded by the laser firing generating plasma which results in shock waves on the surface of the material. These shock waves are re-directed towards the coated surface by the curtain of flowing water or other confining layer 21 to generate travelling shock waves (pressure waves) in the material below the coated surface. The amplitude and quantity of these shockwave determine the depth and intensity of compressive stresses. The coating serves to protect the target surface and also to generate plasma.

The shock peening apparatus 1 as illustrated in FIG. 10 has the blade 8 mounted in a conventionally well known robotic arm 27 used to continuously move and position the blade to provide laser shock peening "on the fly". The blade 8 is continuously moved while the stationary laser beams 2 are continuously fired through a curtain of flowing water 21 on the coated laser shock peened surfaces 54 forming overlapping laser shock peened circular spots 58. The curtain of flowing water 21 is supplied by a water nozzle 23 at the end of a water supply tube 19. The laser shock peening apparatus 1 has a conventional generator 31 with an oscillator 33 and a pre-amplifier 47 and a beam splitter 43 which feeds the pre-amplified laser beam into two beam optical transmission circuits each having a first and second amplifier 39 and 41, respectively, and optics 35 which include optical elements that transmit and focus the laser beam 2 on the laser shock peened surfaces 54. Ablated paint material is washed out by the curtain of flowing water 21. The laser shock peening coated surface 55 is laser shock peened with more than one sequence of firings on the laser shock peening coated surface 55. The present invention includes continuously moving the blade while continuously firing the laser beam on the taped surface such that adjacent laser shock peened circular spots are hit in different sequences. However, the laser beam may be moved instead just so long as relative movement between the beam and the surface is effected.

Figure 6:
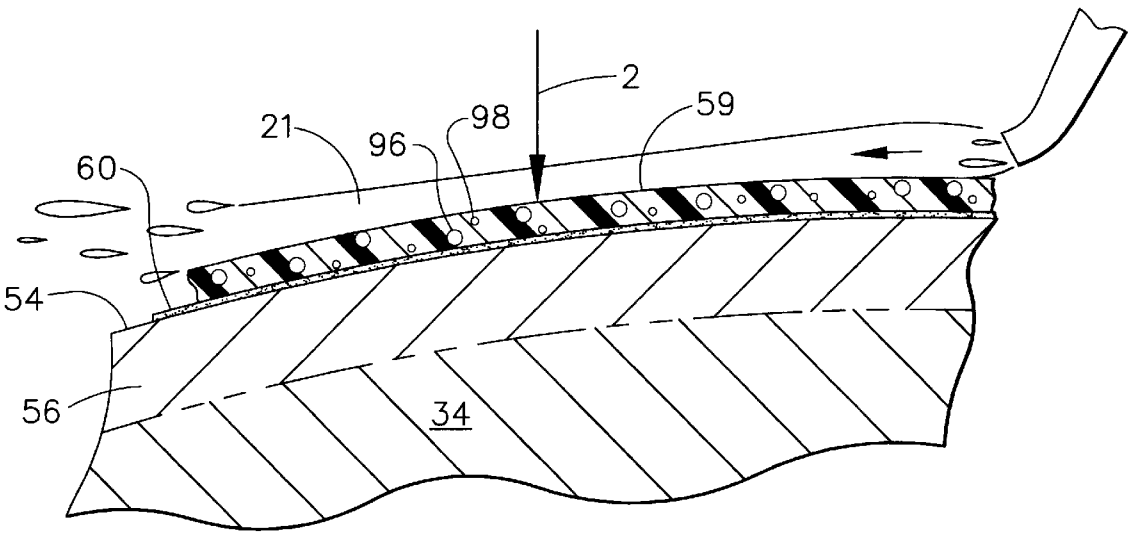
FIG. 6 is a view of the blade having two explosive ingredients in an ablative material of the tape.

FIG. 6 illustrates an embodiment of the invention having two or more explosive ingredients 66 in the ablative material 64 which are represented by first and second explosive ingredients 96 and 98, respectively. Each of the different explosive ingredients has a different shock sensitivity and the laser beam is fired with sufficient power to explode at least some amount of each of the explosive ingredients. Examples of suitable explosive ingredients include nitroglycerin, pentaerythritol tetranitrate, RDX, and ammonium nitrate. Nitroglycerin and ammonium nitrate are thought to be particularly suitable for use as the first explosive ingredient 96.

Figure 7:
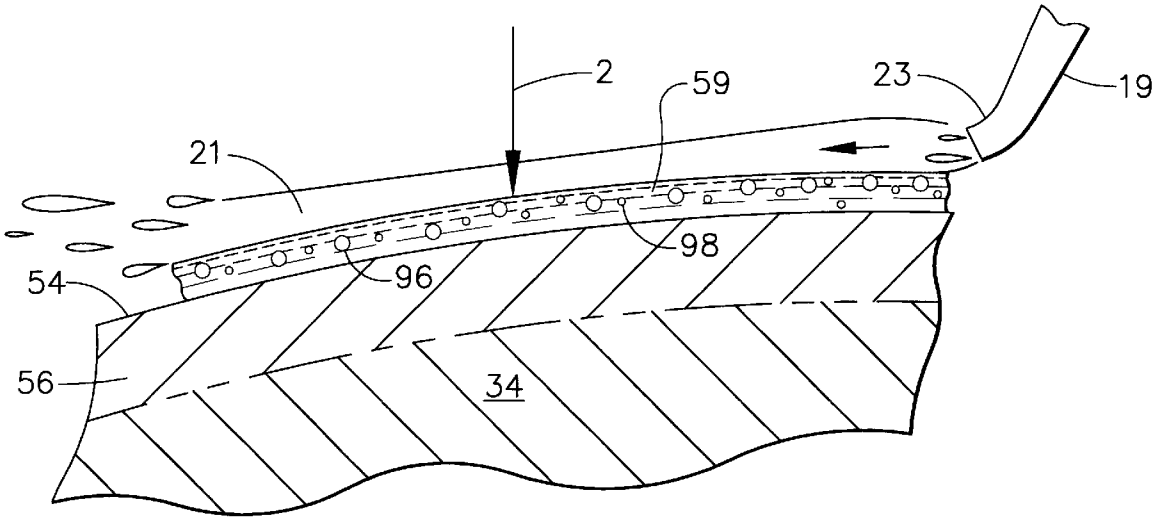
FIG. 7 is a view of the blade having a painted coating with the explosive ingredient and no ablative material in the coating on the laser shock peened surface of the blade.

FIG. 7 illustrates an embodiment of the invention having no ablative layer, just a layer of at least one explosive ingredient 66 or as more particularly illustrated in FIG. 7, the two or more explosive ingredients 66 which are represented in the first and second explosive ingredients 96 and 98, respectively. Each of the different explosive ingredients has a different shock sensitivity and the laser beam is fired with sufficient power to explode at least some amount of each of the explosive ingredients to form the laser shock peening surfaces 54 and the pre-stressed regions 56 having deep compressive residual stresses imparted by laser shock peening (LSP) extending into the airfoil 34 from the laser shock peened surfaces. Suitable explosive ingredients include pentaerythritol tetranitrate, picric acid, or ammonium nitrate. In some embodiments of the invention, the first explosive ingredient 96 is ammonium nitrate and a second explosive ingredient 98 is pentaerythritol tetranitrate or picric acid.

FIG. 8 illustrates an embodiment of the invention having no ablative layer, just a layer of at least one explosive ingredient 66 or as more particularly illustrated in FIG. 7, the two or more explosive ingredients 66 which are represented in the first and second explosive ingredients 96 and 98, respectively. Each of the different explosive ingredients has a different shock sensitivity and the laser beam is fired with sufficient power to explode at least some amount of each of the explosive ingredients to form the laser shock peening surfaces 54 and the pre-stressed regions 56 having deep compressive residual stresses imparted by laser shock peening (LSP) extending into the airfoil 34 from the laser shock peened surfaces. Suitable explosive ingredients include pentaerythritol tetranitrate, picric acid, or ammonium nitrate. In some embodiments of the invention, the first explosive ingredient 96 is ammonium nitrate and a second explosive ingredient 98 is pentaerythritol tetranitrate or picric acid.

Figure 11:
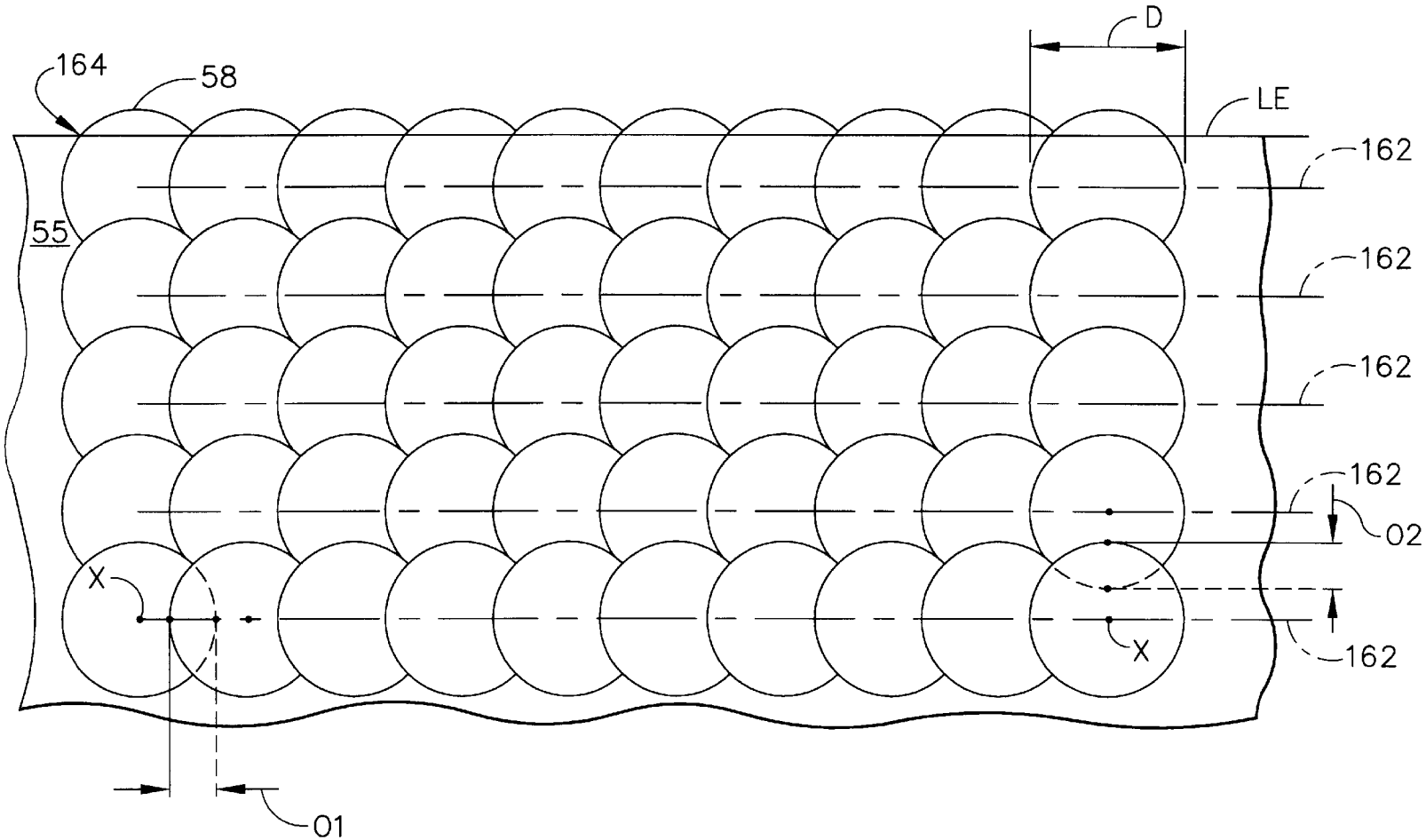
FIG. 11 is a schematic illustration of four sequences of laser shocked peened circular spots that don't overlap within a given sequence on a laser shock peened surface in FIGS. 2 and 4.

FIG. 11 illustrates an exemplary pattern of stacked rows of the overlapping laser shocked peened circular spots 58 (indicated by the circles). All the laser shocked peened circular spots 58 with their corresponding centers X lie along a row centerline 162. The pattern of sequences entirely covers the laser shock peening coated surface 55. The laser shocked peened circular spots 58 have a diameter D in a row 164 of overlapping laser shock peened circular spots. The pattern may be of multiple overlapping rows 164 of overlapping shock peened circular spots on the laser shock peening coated surface 55. A first exemplary overlap, illustrated as about 30%, is between adjacent laser shock peened circular spots 58 in a given row. The overlap is typically defined by a first offset 01 between centers X of the adjacent laser shock peened circular spots 58 and though illustrated as 30% it can vary from about 30%–50% or more of the diameter D. A second overlap is between adjacent laser shock peened circular spots 58 in adjacent rows and is generally defined by a second offset 02 between adjacent row centerlines 162 and though illustrated as 30% it can vary from about 30%–50% of the diameter D depending on applications and the strength or fluency of the laser beam. The pattern is referred to as stacked because the centers X of adjacent spots 58 in adjacent rows are all linearly aligned. Other patterns are disclosed in the references, see U.S. Pat. Nos. 5,591,009, 5,674,329 and 5,674,328. Several sequences may be required to produce the entire pattern and re-taping of the workpiece should be done between each sequence of laser firings. The laser firing of each sequence has multiple laser firings or pulses with a period between firings that is often referred to a "rep". During the rep, the part is moved so that the next pulse occurs at the location of the next laser shocked peened circular spot 58. In the exemplary embodiments illustrated herein, the part is moved continuously and timed to be at the appropriate location at the pulse or firing of the laser beam. One or more repeats of each sequence may be used to hit each laser shocked peened circular spot 58 more than once. This may also allow for less laser power to be used in each firing or laser pulse.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method of laser shock peening a metallic workpiece, said method comprising the following steps:

forming a coated surface by coating a laser shock peening surface on the workpiece with an explosive coating containing at least one explosive ingredient, continuously firing a laser beam, which repeatably pulses between relatively constant periods, on the coated surface of the workpiece while providing continuous movement between the laser beam and the metallic workpiece, and firing the laser beam with sufficient power to vaporize the coating and to explode at least some of the explosive ingredient with the pulses and forming laser beam spots on the coating and forming a region in the workpiece having deep compressive residual stresses imparted by the laser beam pulsing such that the region extends into the workpiece from the laser shock peening surface.

2. A method as claimed in claim 1 wherein said explosive coating containing at least one explosive ingredient is an oxidizer mixed into an ablative material and the laser beam is fired with sufficient power to vaporize the ablative material to explode at least some of the explosive ingredient with the pulses and form laser beam spots on the coating and forming a region in the workpiece having deep compressive residual stresses imparted by the laser beam pulsing such that the region extends into the workpiece from the laser shock peening surface.

3. A method as claimed in claim 2 further comprising firing the laser beam while flowing a fluid curtain over the coated surface upon which the laser beam is firing to form a pattern of overlapping laser beam spots while moving the laser relative to the workpiece.

4. A method as claimed in claim 1 further comprising firing the laser beam while flowing a fluid curtain over the coated surface upon which the laser beam is firing to form a pattern of overlapping laser beam spots while moving the laser relative to the workpiece.

5. A method of laser shock peening a metallic workpiece, said method comprising the following steps:

forming an ablative coated surface by coating a laser shock peening surface on the workpiece with an ablative material containing at least one explosive ingredient, continuously firing a laser beam, which repeatably pulses between relatively constant periods, on the coated surface of the workpiece while providing continuous movement between the laser beam and the metallic workpiece, and firing the laser beam with sufficient power to vaporize the ablative medium of the coating and to explode at least some of the explosive ingredient with the pulses and forming laser beam spots on the coating and forming a region in the workpiece having deep compressive residual stresses imparted by the laser beam pulsing such that the region extends into the workpiece from the laser shock peening surface.

6. A method as claimed in claim 5 further comprising firing the laser beam without flowing a fluid curtain over the coated surface upon which the laser beam is firing to form a pattern of overlapping laser beam spots while moving the laser relative to the workpiece.

7. A method as claimed in claim 5 further comprising firing the laser beam while flowing a fluid curtain over the ablative coated surface upon which the laser beam is firing to form a pattern of overlapping laser beam spots while moving the laser relative to the workpiece.

8. A method as claimed in claim 5 wherein the workpiece is moved linearly to produce a row of overlapping circular laser beam spots having generally equally spaced apart linearly aligned center points.

9. A method as claimed in claim 5 wherein the workpiece is moved and the laser beam is fired to produce more than one row of overlapping circular laser beam spots having generally equally spaced apart linearly aligned center points wherein adjacent rows of spots overlap.

10. A method as claimed in claim 5 wherein the explosive ingredient is nitroglycerin or ammonium nitrate.

11. A method as claimed in claim 5 further comprising forming the ablative coated surface by covering a laser shock peening surface on the workpiece with an ablative material containing two or more explosive ingredients wherein each of the explosive ingredients has a different shock sensitivity and firing the laser beam with sufficient power to explode at least some amount of each of the explosive ingredients.

12. A method as claimed in claim 11 wherein the explosive ingredients are selected from the group consisting of nitroglycerin, pentaerythritol tetranitrate, RDX, and ammonium nitrate.

13. A method as claimed in claim 5 wherein the laser shock peened surface is laser shock peened using a set of sequences wherein each sequence comprises coating the ablative coated surface with the coating and then continuously moving the workpiece while continuously firing a stationary laser beam on the surface such that adjacent laser shock peened circular spots are hit in different ones of said sequences in said set.

14. A method as claimed in claim 13 further comprising a plurality of said sequences wherein essentially each spot is hit more than once in different ones of said plurality and only once in any one of said sequences.

15. A method as claimed in claim 14 wherein the laser beam is fired and the workpiece moved so that the center points of adjacent spots in adjacent rows are offset from each other a generally equal amount in a direction along a line on which the center points are linearly aligned.

16. A method of laser shock peening a metallic workpiece, said method comprising the following steps:

forming a film covered surface by adhesively covering a laser shock peening surface on the workpiece with a film including at least one explosive ingredient mixed into a plasticizer, continuously firing a laser beam, which repeatably pulses between relatively constant periods, on the film covered laser shock peening surface of the workpiece while providing continuous movement between the laser beam and the metallic workpiece, and firing the laser beam with sufficient power to explode at least some amount of the explosive ingredient with the pulses and forming laser beam spots on the film and forming a region in the workpiece having deep compressive residual stresses imparted by the laser beam pulsing such that the region extends into the workpiece from the laser shock peening surface.

17. A method as claimed in claim 16 further comprising firing the laser beam without flowing a fluid curtain over the film covered surface upon which the laser beam is firing to form a pattern of overlapping laser beam spots while moving the laser relative to the workpiece.

18. A method as claimed in claim 16 further comprising firing the laser beam while flowing a fluid curtain over the film covered surface upon which the laser beam is firing to form a pattern of overlapping laser beam spots while moving the laser relative to the workpiece.

19. A method as claimed in claim 16 wherein the workpiece is moved linearly to produce a row of overlapping circular laser beam spots having generally equally spaced apart linearly aligned center points.

20. A method as claimed in claim 16 wherein the workpiece is moved and the laser beam is fired to produce more than one row of overlapping circular laser beam spots having generally equally spaced apart linearly aligned center points wherein adjacent rows of spots overlap.

21. A method as claimed in claim 16 wherein the explosive ingredients are selected from the group consisting of nitroglycerin, pentaerythritol tetranitrate, RDX, and ammonium nitrate.

22. A method as claimed in claim 16 wherein the film includes two or more explosive ingredients mixed into the plasticizer and each of the explosive ingredients has a different shock sensitivity.

23. A method as claimed in claim 22 wherein the explosive ingredients are selected from the group consisting of nitroglycerin, pentaerythritol tetranitrate, RDX, and ammonium nitrate.

24. A method as claimed in claim 22 wherein the laser shock peened surface is laser shock peened using a set of sequences wherein each sequence comprises covering the laser shock peened surface with the film and then continuously moving the workpiece while continuously firing a stationary laser beam on the surface such that adjacent laser shock peened circular spots are hit in different ones of said sequences in said set.

25. A method as claimed in claim 16 wherein the plasticizer includes an ablative material and the laser beam is continuously fired with sufficient power to vaporize the ablative material and explode at least some amount of the explosive ingredient with the pulses and forming laser beam spots on the film and forming a region in the workpiece having deep compressive residual stresses imparted by the laser beam pulsing such that the region extends into the workpiece from the laser shock peening surface.

26. A method as claimed in claim 25 wherein the explosive ingredients are selected from the group consisting of nitroglycerin, pentaerythritol tetranitrate, RDX, and ammonium nitrate.

27. A method as claimed in claim 25 wherein the film includes two or more explosive ingredients mixed into the plasticizer and each of the explosive ingredients has a different shock sensitivity.

28. A method as claimed in claim 27 wherein the explosive ingredients are selected from the group consisting of nitroglycerin, pentaerythritol tetranitrate, RDX, and ammonium nitrate.

29. A method as claimed in claim 25 wherein the laser shock peened surface is laser shock peened using a set of sequences wherein each sequence comprises covering the laser shock peened surface with the film and then continuously moving the workpiece while continuously firing a stationary laser beam on the surface such that adjacent laser shock peened circular spots are hit in different ones of said sequences in said set.

30. A method of laser shock peening a metallic workpiece, said method comprising the following steps:

forming a coated surface by covering a laser shock peening surface on the workpiece with a liquid coating having an ablative material containing at least one explosive ingredient and drying the coating on the laser shock peening surface, continuously firing a laser beam, which repeatably pulses between relatively constant periods, on the coated surface of the workpiece while providing continuous movement between the laser beam and the metallic workpiece, and firing the laser beam with sufficient power to vaporize the ablative material of the dried coating and to explode at least some amount of the explosive ingredient with the pulses and forming laser beam spots on the coated surface and forming a region in the workpiece having deep compressive residual stresses imparted by the laser beam pulsing such that the region extends into the workpiece from the laser shock peening surface.

31. A method as claimed in claim 30 wherein the explosive ingredients are selected from the group consisting of nitroglycerin, pentaerythritol tetranitrate, RDX, and ammonium nitrate.

32. A method as claimed in claim 30 wherein the explosive ingredients are selected from the group consisting of nitroglycerin and ammonium nitrate.

33. A method as claimed in claim 30 wherein the liquid coating includes two or more explosive ingredients and each of the explosive ingredients has a different shock sensitivity.

34. A method as claimed in claim 33 wherein the explosive ingredients are selected from the group consisting of nitroglycerin, pentaerythritol tetranitrate, RDX, and ammonium nitrate.

35. A method as claimed in claim 30 wherein the laser shock peened surface is laser shock peened using a set of sequences wherein each sequence comprises coating the laser shock peened surface and then continuously moving the workpiece while continuously firing a stationary laser beam on the surface such that adjacent laser shock peened circular spots are hit in different ones of said sequences in said set.

36. A method as claimed in claim 35 further comprising a plurality of said sequences wherein essentially each spot is hit more than once in different ones of said plurality and only once in any one of said sequences.

37. A method as claimed in claim 36 wherein the laser beam is fired and the workpiece moved so that the center points of adjacent spots in adjacent rows are offset from each other a generally equal amount in a direction along a line on which the center points are linearly aligned.

38. A method of laser shock peening a metallic workpiece, said method comprising the following steps:

forming a taped surface by adhesively covering a laser shock peening surface on the workpiece with a self adhering tape having an ablative medium layer containing at least one explosive ingredient and having an adhesive layer, continuously firing a laser beam, which repeatably pulses between relatively constant periods, on the taped surface of the workpiece while providing continuous movement between the laser beam and the metallic workpiece, and firing the laser beam with sufficient power to vaporize the ablative medium of the tape and to explode at least some amount of the explosive ingredient with the pulses and forming laser beam spots on the tape and forming a region in the workpiece having deep compressive residual stresses imparted by the laser beam pulsing such that the region extends into the workpiece from the laser shock peening surface.

39. A method as claimed in claim 38 further comprising firing the laser beam while flowing a fluid curtain over the taped surface upon which the laser beam is firing to form a pattern of overlapping laser beam spots while moving the laser relative to the workpiece.

40. A method as claimed in claim 38 wherein the workpiece is moved linearly to produce a row of overlapping circular laser beam spots having generally equally spaced apart linearly aligned center points.

41. A method as claimed in claim 38 wherein the workpiece is moved and the laser beam is fired to produce more than one row of overlapping circular laser beam spots having generally equally spaced apart linearly aligned center points wherein adjacent rows of spots overlap.

42. A method as claimed in claim 38 wherein the explosive ingredients are selected from the group consisting of nitroglycerin, pentaerythritol tetranitrate, RDX, and ammonium nitrate.

43. A method as claimed in claim 38 wherein the explosive ingredients are selected from the group consisting of nitroglycerin and ammonium nitrate.

44. A method as claimed in claim 38 wherein the taped surface is covered with the tape having the ablative material containing two or more explosive ingredients wherein each of the explosive ingredients has a different shock sensitivity.

45. A method as claimed in claim 44 wherein the explosive ingredients are selected from the group consisting of nitroglycerin, pentaerythritol tetranitrate, RDX, and ammonium nitrate.

46. A method as claimed in claim 44 wherein the explosive ingredients are selected from the group consisting of nitroglycerin and ammonium nitrate.

47. A method as claimed in claim 38 wherein the laser shock peened surface is laser shock peened using a set of sequences wherein each sequence comprises coating the surface with the coating and then continuously moving the workpiece while continuously firing a stationary laser beam on the surface such that adjacent laser shock peened circular spots are hit in different ones of said sequences in said set.

48. A method as claimed in claim 47 further comprising a plurality of said sets of sequence wherein essentially each spot is hit more than once in different ones of said plurality and only once in any one of said sequences.

* * * * *